United States Patent [19]

Eberhard et al.

[11] Patent Number: 4,959,025

[45] Date of Patent: Sep. 25, 1990

[54] ELECTRICAL APPARATUS PLUG

[75] Inventors: Walter Eberhard, Horgen; André Simmler, Wäden swil, both of Switzerland

[73] Assignee: Feller AG, Horgen, Switzerland

[21] Appl. No.: 398,933

[22] Filed: Aug. 28, 1989

[30] Foreign Application Priority Data

Sep. 9, 1988 [CH] Switzerland ..... 386/88

[51] Int. Cl.[5] ..... H01R 33/95

[52] U.S. Cl. ..... 439/622; 337/197; 337/230

[58] Field of Search ..... 439/621, 622; 337/186, 337/187, 197, 198, 230, 257

[56] References Cited

U.S. PATENT DOCUMENTS

| | | | |
|---|---|---|---|
| 4,222,627 | 9/1080 | Cox et al. | 439/622 |
| 4,443,050 | 4/1984 | Taylor | 439/622 |
| 4,489,300 | 12/1984 | Hollenstein et al. | 337/197 |
| 4,568,137 | 2/1986 | Leuthold | 439/622 |

FOREIGN PATENT DOCUMENTS

| | | | |
|---|---|---|---|
| 2707442 | 11/1977 | Fed. Rep. of Germany | 439/621 |
| 607366 | 12/1978 | Switzerland . | |

*Primary Examiner*—Gary F. Paumen

*Attorney, Agent, or Firm*—Laurence R. Brown

[57] ABSTRACT

Three terminal prongs are anchored in the base (1) of the apparatus plug. For a bipolar fuse protection thereof two safety fuse cartridges (10) are located in a fuse carrier (8) in a separate adjacent base compartment (7) into which fuse carrier (8) can be inserted and be withdrawn and which opens over the upper side of the base and has a selected depth for a minimal mounting depth. The bottom cap (12) of the safety fuse cartridge rests against a bottom contact terminal (14) located fixed at the bottom of the base compartment with a connecting lug (15) extending towards the outside of the base and electrically connected with a connecting lug of one terminal prong (4). The top cap (13) of the safety fuse cartridge is embraced by a contact hood (23) guided for movement against the action of a spring (24) and carries a contact tongue (22) projecting from the edge of the contact hood which upon inserting of the fuse carrier into the separate socket compartment (7) is slid betwen a leaf spring pair (20) mounted fixedly to the compartment inner wall. By means of such, an electrical connection is established from the connecting lug of the leaf spring pair extending towards the outside via the safety fuse to one of the terminal prongs (2 or 4) anchored in the base and in an exactly same arrangement a further of the two safety fuse cartridges held in the cartridge carrier is allocated to the second terminal prong. The fuse carrier (8) has an elastic tongue (25) carrying detent members for mating to hold the fuse carrier in the base. The tongue is positioned adjacent the partition (5) for receiving a connecting power plug so that the fuse carrier (8) cannot be removed without removing the power plug.

6 Claims, 1 Drawing Sheet

ELECTRICAL APPARATUS PLUG

BACKGROUND OF THE INVENTION

1. Field of the invention

The present invention relates to an electrical apparatus plug having a base consisting of an insulating material and a plurality of contact terminal members anchored therein and intended for an electrical coupling to the plug-in socket of a cable; A safety fuse device is insertable into a separate compartment in the base having a fuse carrier consisting of an insulating material and intended for holding safety fuse cartridges. The carrier is withdrawable from the separate compartment in a guided manner, and is held by detent means.

The contact terminal members anchored in the base are preferably contact pins intended to engage into female contact receptacles of a pluggable coupling of an electrical current supply cable.

2. Description of the Prior Art

A design of electrical apparatus plugs having contact terminal members protected by a fuse is known in which the carrier for the safety fuse cartridge which is releasably mounted to the base by means of a screw thread or bayonet catch. That carrier can be withdrawn if the contact terminal members are engaged or plugged into the female contact receptacles of a pluggable coupling of a cable when the apparatus plug is alive. Such should definitely be avoided and according to the regulations is allowed only when using a tool.

An electrical apparatus plug in which the exchanging of the safety fuse cartridge is not possible as long as the apparatus having the apparatus plug is alive, is disclosed in the Swiss Patent Specification No. CH-A-607 366. The fuse carrier of this apparatus plug which is guided in the base in a drawer like fashion for its withdrawal can be grasped only if the current carrying pluggable coupling which is inserted directly adjacent the withdrawable fuse carrier has been pulled out such that the desired safety regarding electrical accidents is met. This known electrical apparatus plug allows only a single pole fuse protection because only one safety fuse cartridge can be placed extending transversely into the fuse carrier which is guided in a drawer like fashion in the base of the apparatus, by means of which single fuse cartridge only a single pole fuse protection is possible.

SUMMARY OF THE INVENTION

It is, therefore, a general object of the present invention to provide an electrical apparatus plug for a bipolar fuse protection and such that a withdrawing of the fuse carrier including the safety fuse cartridge is not possible as long as the contact terminals of the apparatus plug are engaged or plugged into a live coupling.

A further object of the present invention is to provide an electrical apparatus plug having two receiving receptacles for the receipt of one respective safety fuse cartridge and consisting of an insulating material formed in two separate compartments parallel adjacent each other and extendIng in the direction of movement of the fuse carrier which is guided movably in one of the separate compartment allowing a bipolar fuse protection, and having further a bottom contact terminal located at the floor of each receiving receptacle and contacting one of the two caps of a safety fuse cartridge. A connecting lug extends towards the outside of the base for a connection to one of the contact terminal members. A contact piece each located between each respective fuse receiving receptacle has the base compartment wall and a connecting lug extending towards the outside of the base to form part of a pluggable contact coupling. The counter contact piece is located at the fuse carrier to be insertably guided in to the base compartment and electrically connected in its inserted position and is formed integrally with a contact hood comprising an electrical contact clip which is displaceably held against the action of a spring in the fuse carrier and is in an electrical contact with the other cap of the safety fuse cartridge.

Still a further object is to provide an electrical apparatus plug in which the inserted fuse carrier projects over the open top side of the base with an operating lever projecting also over the side of the fuse carrier facing the terminal prongs anchored in the base and formed as an elastically yielding tongue including detent members which are engageable into the base. Such operating lever can be manually operated for a disengaging of the detent member only if the pluggable coupling has been pulled out from the apparatus plug.

BRIEF DESCRIPTION OF THE DRAWINGS

The invention will be better understood and objects other than those set forth above, will become apparent when consideration is given to the following detailed description thereof. Such description makes reference to the annexed drawings wherein.

DESCRIPTION OF THE PREFERRED EMBODIMENT

Figure 2:
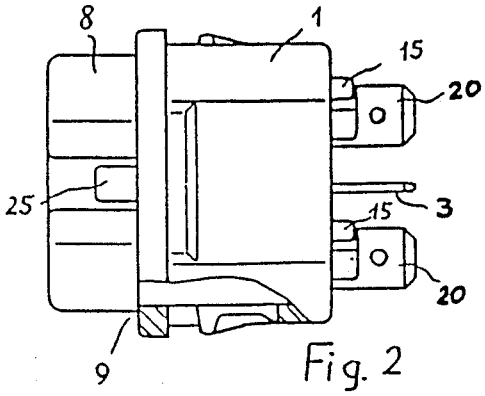
FIG. 2 is a side view of the apparatus plug seen in the direction of the arrow A of FIG. 1.
Figure 1:
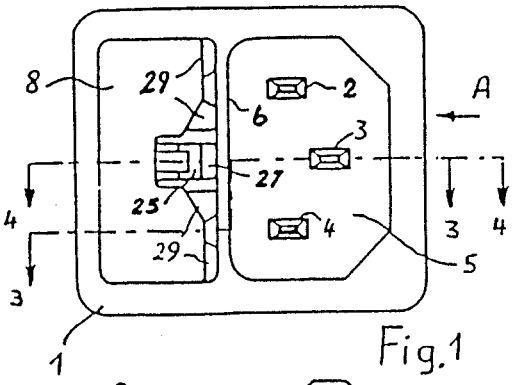
FIG. 1 is a top view of the apparatus plug including the inserted fuse carrier.
Figure 3:
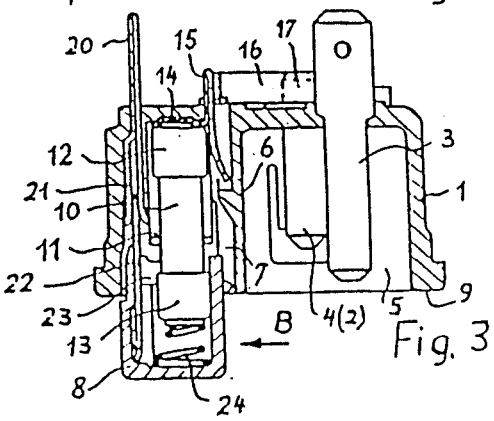
FIG. 3 is a vertical section through the apparatus plug along line 3—3 of FIG. 1.

The electrical apparatus plug includes a base 1 made of an electrically insulating material in which as shown in FIG. 1 three terminal prongs or pins 2, 3, 4 are anchored at the right hand side which prongs are intended to engage into contact receptacles of a not particularly illustrated plug contact coupling of cable through which electrical current is supplied. The compartment 5 within the base into which the three terminal prongs project from the bottom or floor of the base is separated by a partition 6 from a separate socket compartment 7. A fuse carrier 8 is located in the separate socket compartment 7 and guided such that it can be withdrawn and inserted According to the illustration of FIG. 2 this fuse carrier 8 projects upwards over the top side 9 of the base 1 and is intended for receiving two safety fuse cartridges 10 of which one is illustrated in FIG. 3. The two safety fuse cartridges 10 are arranged in the fuse carrier 8 adjacent each other and upright, i.e., parallel to the terminal prongs 2, 3, 4 anchored in the base 1. Two thin walled receiving receptacles 11 of which one is illustrated in FIG. 3 are formed in the separate socket compartment 7 integrally with the base 1 consisting of an electrically insulating material. In each of these receiving receptacles 11 one safety fuse cartridge 10 is received. Each fuse cartridge 10 includes a bottom cap 12 and a top cap 13. The bottom cap 12 rests against a bottom contact terminal 14 set firmly into the bottom of the receiving receptacle 11 in the base 1, which bottom contact terminal 14 includes a connecting lug 15 extending towards the outer side of the base. This connecting lug 15 is connected in an electrically conducting state to a connecting lug 17 via a connector 16, which connecting lug 17 is integral with the terminal prong 4 anchored in the base and extends towards the outer side of the base. In the same manner an electrically conductive connection is established between the terminal prong 2 and a second connecting lug 15, which terminal prong 2 is anchored in the base and includes a connecting lug 18 as illustrated in FIG. 1 and extends towards the outer side of the base and contacts a similarly designed connector 16 which in turn contacts mentioned second connecting lug 15, which lug 15 is made integral with the bottom contact terminal 14 contacting the second safety fuse cartridge.

The top cap 13 of the safety fuse cartridge 10 is held in the fuse carrier 8 guided in the separate socket compartment such that it can be withdrawn and inserted, and the current flows to this top cap 13 from a connecting lug 20 extending at the base 1 at its bottom towards the outer side of the base and due to the flexibility or mobility of the fuse carrier 8 via a pluggable contact coupling 21, 22 which is located between the receiving receptacle 11 for the safety fuse cartridge 10 and the outer wall of the socket and of which the one contact piece is a pair of leaf springs 21 which are resiliently biased one against another and are made integral with the connecting lug 20. The counter contact piece of this contact coupling piece 21 is a metallic tongue 22 which is insertable between the pair of leaf springs 21 and is made integral with a contact hood 23 which encases the top cap 13 of the safety fuse cartridge 10. The tongue 22 is located in the fuse carrier 8 within which the contact hood 23 is guided moveably and is pressed against the safety fuse cartridge 10 due to the action of a spiral pressure spring 24 resting against the fuse carrier. Because this apparatus plug comprises two adjacently located safety fuse cartridges 10 the fuse carrier 8, illustrated in its separated state in FIGS. 6 and 7, includes accordingly two contact hoods 23 having contact tongues 22 projecting therefrom. When the fuse carrier 8 is inserted into the separate base compartment the two contact tongues 22 come to engage the respective leaf spring pair 21 leading to an electrical conductivity such that the two terminal prongs 2 and 4 of the base 1 intended for a connecting to a plug of a cable receive the electrical current fed thereto from the two connecting lugs 20 located in the base via the respective safety fuse cartridge 10 such that this apparatus plug comprises a bipolar fuse protection. The contact coupling 21, 22 designed as a pluggable coupling can obviously be arranged the other way round, i.e., the pair of leaf springs can also be located at the fuse carrier part 8 and the tongue intended to be inserted therebetween can be located at the base.

Figure 4:
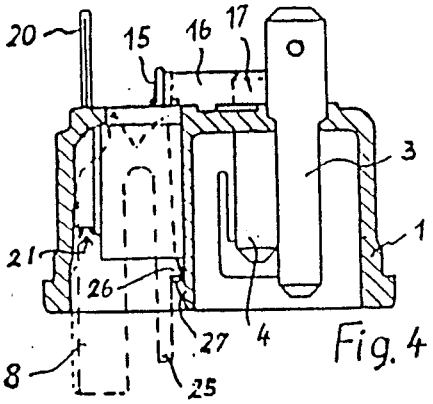
FIG. 4 is a vertical section through the apparatus plug along line 4—4 of FIG. 1.
Figure 5:
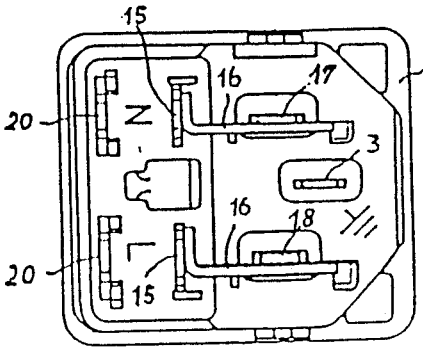
FIG. 5 is a view of the bottom side of the apparatus plug.

The fuse carrier 8 consisting of an electrically insulating material is as shown in FIG. 1 designed at its upper part in the middle between the receiving spaces for receipt of one respective safety fuse cartridge narrower when viewed from above, i.e.,in top view. A vertical section through the fuse carrier at this middle part is illustrated in FIG. 4 in broken lines. An operating lever 25 is located in the center of the fuse carrier and is integrally mounted to the remaining fuse carrier and is designed as an elastic tongue extending upwards. This operating lever 25 includes a detent member in the form of a projection 26 formed onto its outer side. A lug 27 acting as a further detent member is formed at the center of the partition 6 of the base 1 and on its surface facing the separate base compartment 7 which lug 27 extends then behind the projection 26 at the elastic tongue 25 of the fuse carrier 8 when the fuse carrier has been inserted into the separate socket compartment 7. When the fuse carrier is pressed downwards these detent members snap into each other automatically. The elastic tongue 25 at the fuse carrier 8, which tongue acts as operating lever, can be operated only if the space in front of it is empty, i.e., when no plug-in coupling of an electrical cable engaging the terminal prongs is present. This assures that a safety fuse cartridge can be withdrawn and replaced only if the apparatus having such apparatus plug is not electrically alive.

Figure 6:
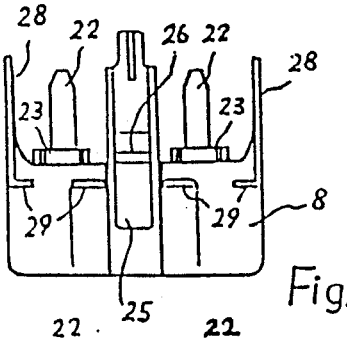
FIG. 6 illustrates the fuse carrier in a condition separated from the base in the direction of the arrow B of FIG. 3.
Figure 7:
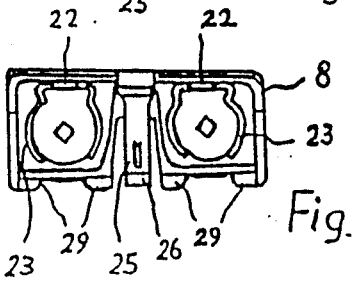
FIG. 7 is a bottom view of the fuse carrier according to FIG. 6.

As illustrated in FIGS. 6 and 7 the fuse carrier 8 includes at its two narrow sides freely projecting guide surfaces 28 for an easy and precise inserting of the fuse carrier 8 into the separate socket compartment and includes further at the side comprising the operating lever 25 at the right hand and at the left hand side projections formed thereonto which in the inserted state of the fuse carrier 8 rest aligned with the upper edge of the partition of the base 6 and secure a safe seating of the fuse carrier.

The surface of the fuse carrier 8 which faces upwards can be suitably equipped with inscriptions for characterizing the rated current and the particulars of the response of the safety fuse cartridges to be used.

While there is shown and described a present preferred embodiment of the invention, it is to be distinctly understood that the invention is not limited thereto, but may be otherwise variously embodied and practiced within the scope of the following claims.

We claim:

1. An electrical apparatus plug connecting module comprising in combination:

a base of an insulating material and a plurality of contact terminal members anchored therein in a first compartment and intended for electrical coupling of a power line cable plug to said terminal members, and having a safety fuse holder in a separate compartment in the base adjacent to the first compartment into which a fuse carrier is insertable and from which the fuse carrier is withdrawable in a guided manner, and a fuse carrier of an insulating material intended for holding two safety fuse cartridges when inserted into the separate compartment, said fuse carrier being shaped to project above an open top side of said first compartment and said separate compartment, said fuse carrier further being provided on a side facing said contact terminal members anchored in said first compartment with a manually operable operating lever extending above the open top side of said separate compartment, said operating lever providing a manually accessible yielding tongue integral with said fuse carrier and carrying a manually operable first detent member formed on said operating lever for cooperating with a second detent member formed on a partition wall between the separate compartment and the first compartment so that the yielding tongue is manually operable only if said plug is removed from said first compartment thereby to allow manual access to the operating lever for withdrawing of said fuse carrier out of said base after moving the detent members away from one another.

2. The electrical apparatus of claim 1, in which the detent members are projections formed on said yielding tongue and on said partition wall of the base respectively.

3. The electrical apparatus of claim 1, in which the fuse carrier comprises two contact connector clips (23) for encasing of top caps (13) of two respective fuse cartridges, each clip having an electrical contact tongue (22) for insertion between a pair of leaf springs (21) mounted in said separate compartment and resiliently biased against one another for forming a pluggable contact coupling (21,22) for ensuring electrical contact within the base to the top caps of the fuses which project above the open top side of said base.

4. The electrical apparatus of claim 3, further comprising an axial pressure spring (24) located in said fuse carrier for bearing upon each of said top caps.

5. The electrical apparatus of claim 1 further comprising fuse holding structure in said fuse carrier for removing fuses from said separate compartment in an axial direction parallel to an insertion axis for the fuse carrier into the separate compartment.

6. The electrical apparatus of claim 5 further comprising a substantially cylindrical connector clip (23) member in said separate compartment for receiving a cap member of a fuse axially thereinto in electrical contact.

* * * * *

UNITED STATES PATENT AND TRADEMARK OFFICE

CERTIFICATE OF CORRECTION

PATENT NO. : 4,959,025

DATED : September 25, 1990

INVENTOR(S) : Walter Eberhard & Andre Simmler

It is certified that error appears in the above-identified patent and that said Letters Patent is hereby corrected as shown below:

Title page, item [30]:

Change the number of the Swiss Priority document to 03 386/88.

Signed and Sealed this

Twenty-fourth Day of December, 1991

*Attest:*

HARRY F. MANBECK, JR.

*Attesting Officer*

*Commissioner of Patents and Trademarks*